United States Patent [19]

Hunziker

[11] 4,368,599

[45] Jan. 18, 1983

[54] APPARATUS FOR TRANSPORT AND SIMULTANEOUS SURFACE-TREATMENT OF DISCRETE COMMODITIES

[76] Inventor: Werner Hunziker, Staffelbachstrasse 195, Kirchleerau, Switzerland, CH-5054

[21] Appl. No.: 165,209

[22] Filed: Jul. 1, 1980

Related U.S. Application Data

[63] Continuation of Ser. No. 812,313, Jul. 1, 1977, Pat. No. 4,218,854.

[30] Foreign Application Priority Data

Jul. 20, 1976 [CH] Switzerland ..... 9261/76

[51] Int. Cl.[3] ..... B24C 3/14

[52] U.S. Cl. ..... 51/418; 51/423; 198/700; 198/804

[58] Field of Search ..... 51/418, 422, 423; 134/125; 198/658, 699, 700, 715, 804; 144/208 F, 208 B

[56] References Cited

U.S. PATENT DOCUMENTS

| | | | |
|---|---|---|---|
| 1,882,443 | 10/1932 | Peik | 51/422 |
| 2,131,768 | 10/1938 | Turnbull | 51/422 |
| 2,131,772 | 10/1938 | Turnbull | 51/423 |
| 2,563,084 | 8/1951 | Turnbull | 51/423 |
| 3,390,487 | 7/1968 | Streng | 51/423 |
| 3,585,758 | 6/1971 | Harper | 51/422 |
| 3,830,356 | 8/1974 | Hunziker | 198/782 |
| 3,883,997 | 5/1975 | Burlingame | 51/422 |
| 4,003,164 | 1/1977 | Carpenter | 51/422 |

*Primary Examiner*—Nicholas P. Godici

*Attorney, Agent, or Firm*—Kontler, Grimes & Battersby

[57] ABSTRACT

Apparatus for transporting, agitating, rotating and treating discrete objects, such as metallic parts, has an endless band which is trained over two sets of rollers and forms a trough between the two sets of rollers. The band is driven by at least one set of the rollers and is tensioned at a level below the trough. The objects are admitted into one end of the trough and move up and down in response to movement of the band as well as in a direction toward the other end of the trough, either because the trough slopes downwardly toward the other end or under the action of a helix in the trough. The helix can form part of the band, or it can constitute a discrete part which is rotated in the trough. One or more impellers and/or nozzles are provided above the trough to spray solid or liquid treating agents onto the objects.

19 Claims, 22 Drawing Figures

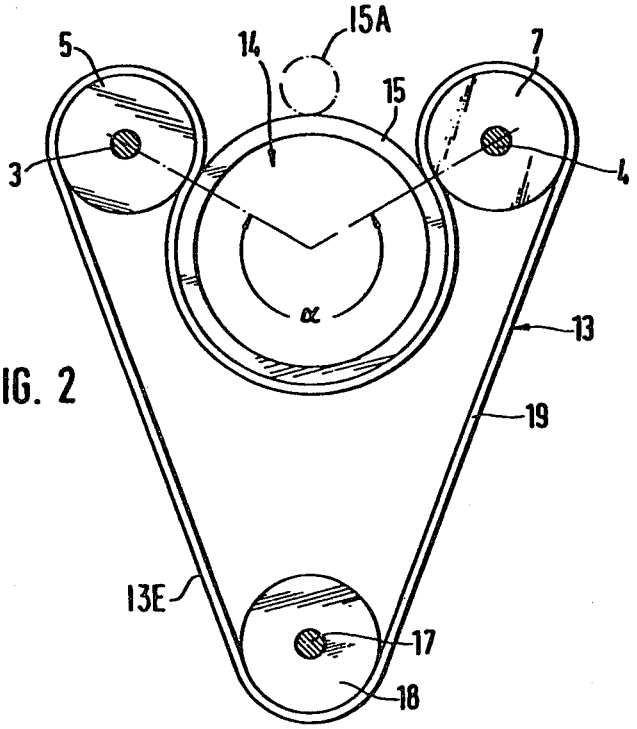
FIG. 2
FIG. 3
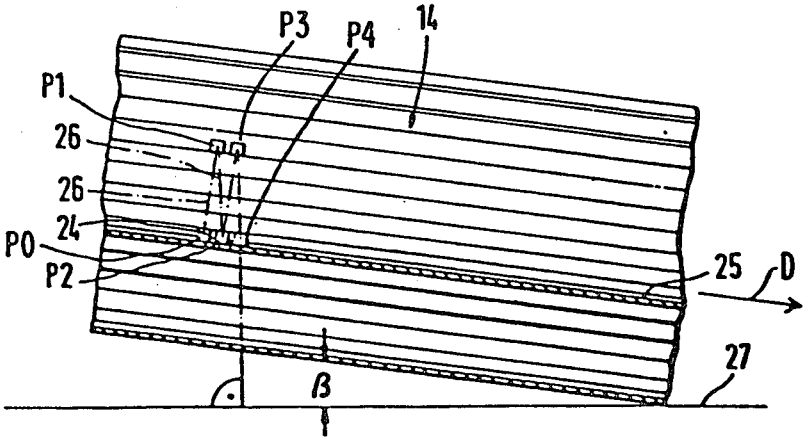

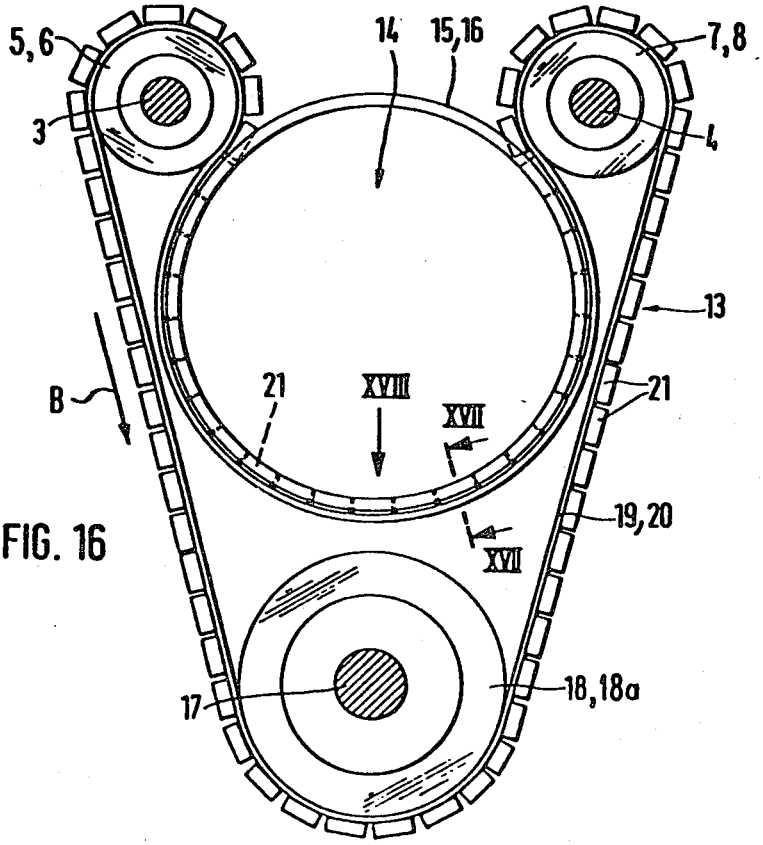
FIG. 16
FIG. 17
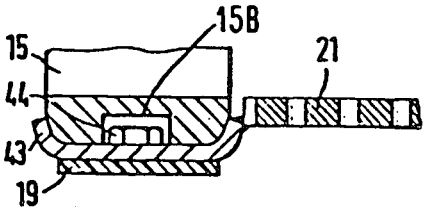
FIG. 18
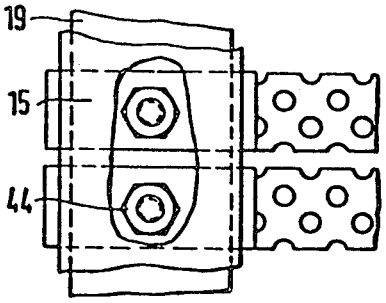

APPARATUS FOR TRANSPORT AND SIMULTANEOUS SURFACE-TREATMENT OF DISCRETE COMMODITIES

This is a continuation, of application Ser. No. 812,313, filed July 1, 1977, now U.S. Pat. No. 4,218,854.

BACKGROUND OF THE INVENTION

The present invention relates to apparatus for transporting and simultaneously treating discrete commodities, such as levers, castings, casings, fittings or the like. More particularly, the invention relates to improvements in apparatus of the type disclosed in my U.S. Pat. No. 3,830,356 granted Aug. 20, 1974.

U.S. Pat. No. 3,830,356 discloses an apparatus wherein discrete commodities are admitted into one end of an elongated channel wherein the commodities advance toward the other end and are simultaneously treated by a liquid medium or by a flowable solid material, such as steel shot. The channel is defined by two or more parallel rollers which are rotated to continuously change the orientation of the commodities during travel from the one toward the other end of the channel. Each roller is provided with a plurality of asymmetrical elastic conveying elements which are inclined in the direction of desired movement of the commodities and can yield in the radial direction of the respective rollers. The distance between the rollers is selected in such a way that the commodities cannot escape therebetween. The conveying elements, which consist of rubber or other elastomeric material, are resistant to the action of washing liquids and to the action of soft blasting agents. However, their resistance to the action of steel shot or the like is low. Therefore, the versatility of the patented apparatus is rather limited; for example, the useful life of such apparatus is short if the commodities must be subjected to the action of one or more liquid washing agents as well as to the action of hard solid particles which are propelled at an elevated speed against the commodities in the channel.

It was further proposed to treat discrete commodities in a conveyor which includes an endless band assembled of steel plates or an endless rubber band. The band defines a channel which is open at one end, at one side and from above. The commodities to be treated are admitted from above into one end of the channel, and the band is driven in a direction to entrain the commodities from the bottom zone of the channel until they fall back into the bottom zone by gravity. In order to remove treated commodities, the direction of movement of the band is reversed so that the commodities are discharged through the open side of the channel. A drawback of such apparatus is that they can only process batches of commodities, i.e., the treatment must be interrupted whenever a freshly treated batch is to be removed from the channel. Moreover, the apparatus must employ a conveyor which defines a channel of large cross-sectional area so as to allow for simultaneous treatment of a substantial number of commodities. Consequently, the commodities which are admitted into the channel and rise with the upwardly moving portion of the band often reach substantial heights before they drop back into the lower portion of the channel. This can result in damage to or destruction of the commodities.

OBJECTS AND SUMMARY OF THE INVENTION

An object of the invention is to provide a novel and improved apparatus which can be used for continuous treatment of discrete commodities and whose parts can stand mechanical impacts, corrosive influence and/or other effects of agents which are used to subject the surfaces of commodities to one or more treatments.

Another object of the invention is to provide an apparatus which insures predictable continuous movement of commodities therethrough, which can be designed to effect more or less pronounced agitation and attendant changes in orientation of conveyed commodities, and which can be rapidly converted for optimum treatment of different types of commodities.

A further object of the invention is to provide the apparatus with novel and improved means for effecting the movement of commodities therein in a desired direction and at a selected speed.

An additional object of the invention is to provide a novel and improved conveyor for use in the above outlined apparatus.

An ancillary object of the invention is to provide an apparatus which can be used as a superior substitute for the aforedescribed conventional apparatus.

The invention is embodied in an apparatus for continuously transporting and changing the orientation (especially rotating) of metallic objects or other discrete commodities. The apparatus comprises substantially parallel first and second direction changing means (e.g., two parallel shafts with pulleys or sprocket wheels), an endless band-like conveyor which is trained over the direction changing means and has an elongated trough-shaped portion between the direction changing means (i.e., the conveyor is not taut between the direction changing means but forms a loop whose bottom zone is located at a level below the direction changing means and is open at the top and preferably at both ends), a feeding station disposed at one end of the trough-shaped portion to admit discrete commodities into the one end, means for driving the conveyor so that successive increments thereof advance from the one direction changing means, below the trough-shaped portion, toward and over the other direction changing means, thereupon from the other direction changing means toward the one direction changing means to thereby lift the commodities from the bottom zone of the trough-shaped portion and to allow the lifted commodities to descend back into the bottom zone by gravity before the commodities reach the one direction changing means, and thereupon over the one direction changing means, and means for moving the commodities in a direction from the one toward the other end of the trough-shaped portion. The moving means may constitute a frame which supports the direction changing means in such a way that the trough-shaped portion slopes downwardly from the one toward the other end, a helix which is inserted into the trough-shaped portion and preferably rotates while the conveyor is in motion, or one or more helical ribs provided on the conveyor to impart to the commodities in the trough-shaped portion a movement in the aforementioned direction while the conveyor is in motion.

The apparatus preferably further comprises means for directing at least one flowable treating agent (such as steel shot, other solid material, or one or more liquids) against the commodities in the trough-shaped portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a schematic transverse vertical sectional view substantially as seen in the direction of arrows from the line II—II of FIG. 1;

FIG. 3 is an enlarged fragmentary side elevational view of the conveyor in the apparatus of FIG. 1;

FIG. 16 is a transverse vertical sectional view of a portion of a sixth apparatus;

FIG. 17 is an enlarged sectional view as seen in the direction of arrows from the line XVII—XVII of FIG. 16;

FIG. 18 is an enlarged plan view of a portion of the conveyor as seen in the direction of arrow XVIII of FIG. 16;

DESCRIPTION OF THE PREFERRED EMBODIMENTS

Figure 1:
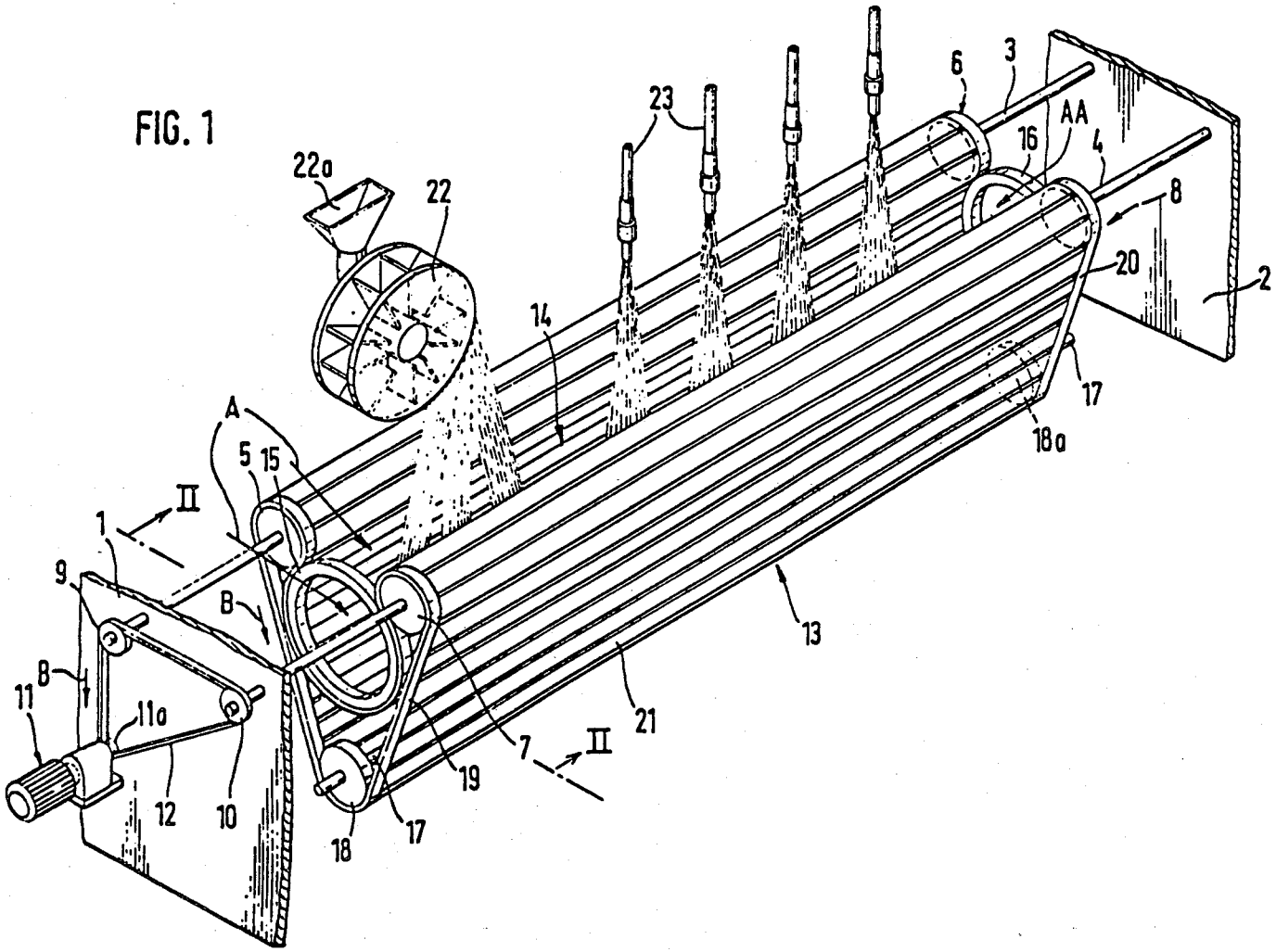
FIG. 1 is a perspective view of an apparatus which embodies one form of the invention and is used for treatment of discrete commodities with streams of solid particulate material as well as with liquid streams.

Referring first to FIGS. 1 to 3, there is shown an apparatus which serves to transport discrete commodities (e.g., levers, housings, fittings and/or other metallic parts) along a predetermined path and in a predetermined direction (arrow D in FIG. 3), namely, from a feeding station A to a discharging station AA. The apparatus comprises a frame or housing including two spaced-apart upright frame members 1 and 2 which support two parallel shafts 3 and 4. The housing including the frame members 1 and 2 may form part of a blasting or washing machine.

The shafts 3 and 4 are respectively rigid with rotary members (e.g., pulleys) 5, 6 and 7, 8. The pulleys 5 and 7 are located in a common plane adjacent to the inner side of the front frame member 1, and the pulleys 6 and 8 are located in a common plane adjacent to the inner side of the rear frame member 2.

The shafts 3 and 4 extend forwardly beyond the frame member 1 and carry pulleys 9 and 10 for a V-belt 12. The latter is further trained over a pulley 11*a* on the output element of a prime mover 11, e.g., an electric motor, which is attached to the frame member 1. The direction in which the motor 11 drives the pulley 11*a* is indicated by the arrow B.

The apparatus further comprises a conveyor 13 which is an endless flexible band and includes an elongated trough-shaped portion 14 (hereinafter called trough) in the space between the shafts 3 and 4. This trough receives discrete commodities 24 (see FIG. 3) at the station A and transports the commodities toward the station AA. The commodities 24 in the trough 14 are treated during travel from the station A to the station AA. Two floating ring-shaped inserts 15 and 16 are provided at the front and rear ends of the trough 14 to insure that those portions of the band 13 which define the trough retain their shape while the motor 11 of the driving means for the band is on. The insert 15 is located at a level below and in the plane of the pulleys 5, 7, and the insert 16 is located at a level below and in the plane of the pulleys 6 and 8. The common axis of the inserts 15 and 16 is parallel to the axes of the shafts 3 and 4. That portion of the band 13 which defines the trough 14 is trained over the pulleys 7 and 8, over the inserts 15, 16, and over the pulleys 5 and 6. If the commodities 24 to be treated in the trough 14 are not introduced through the insert 15, the latter can be replaced with a disk. The central opening of the insert 16 allows the treated commodities to leave the trough 14. The parts 3, 5, 6 and 4, 7, 8 can be said to constitute two direction changing units over which the band 13 is trained in such a way that the portion (trough 14) between the two direction changing units extends to a level below the pulleys 5–8 to define an elongated path for movement of commodities from the station A toward the station AA. The upper end of the trough 14 is open.

The means for biasing the band 13 against the inserts 15, 16 includes a tensioning device which can be said to constitute a dancer roll and includes a shaft 17 connected with two rollers 18, 18*a*. The tensioning device is installed in the bight of a loop-shaped portion 13E of the band 13 at a level below the trough 14, and its weight suffices to insure that the band is held in satisfactory frictional engagement with the parts 5–8 and 15,16. The shaft 17 is parallel to the shafts 3 and 4. The tensioning device including the shaft 17 and rollers 18, 18*a* further serves to respectively urge the inserts 15, 16 against the pulleys 5, 7 and 6, 8. FIG. 2 shows that the band 13 engages the peripheries of the inserts 15, 16 along an angle alpha which exceeds 180 degrees; therefore, the inserts need not be held in the illustrated positions by any auxiliary components, such as guides, bearings, shafts or the like. In other words, it suffices to utilize a tensioning device 17, 18, 18*a* whose weight is sufficient to insure that the inserts 15, 16 respectively bear against the pulleys 5, 7 and 6, 8. If the angle alpha equals or is less than 180 degrees, the apparatus may comprise auxiliary guide means for the inserts 15 and 16. FIG. 2 shows, by a phantom line, an auxiliary guide roll or wheel 15A above the apex of the insert 15. A similar guide roll is provided above the insert 16 if the angle of contact between the band 13 and the insert 16 is not greater than 180 degrees.

The band 13 comprises two endless end portions or flexible elements 19 and 20 which are respectively trained over the parts 5, 18, 7, 15 and 6, 18*a*, 8, 16, and a plurality of elongated connecting members here shown as slats 21 whose end portions are connected to the respective flexible elements 19 and 20. The spacing between neighboring slats 21 depends on a number of factors. Thus, the band 13 should be sufficiently flexible to travel around the pulleys and inserts, especially around the inserts, and the band should be capable of confining the commodities to travel in the trough 14. On the other hand, the gaps between the slats 21 should be sufficiently wide to allow for satisfactory outflow of a washing medium (liquid) which treats the surfaces of the commodities in the trough 14 and/or for evacuation of steel shot or other flowable solid material which is used to subject the surfaces of the commodities 24 to a blasting action. The selection of material which is used to make the slats 21 also depends on a number of factors, such as the anticipated maximum weight of the commodities in the trough 14, the pressure of the blasting or washing agent which is directed against the commodities, the nature of the blasting or washing agent (e.g., whether or not the agent contains corrosive substances), and the width of the band 13. If the width of the band is substantial, it may comprise one or more intermediate flexible elements which prevent excessive flexing and resulting separation of slats in the space between the inserts 15 and 16.

If the flexible elements 19 and 20 are belts, the rotary members 5–8 are pulleys (or toothed pulleys if the belts have internal teeth). On the other hand, if the flexible elements 19 and 20 are chains, the rotary members 5–8 are sprocket wheels.

The trough 14 slopes downwardly in a direction from the station A toward the station AA. FIG. 3 shows that the inclination (angle beta) of the trough 14 with respect to a horizontal plane 27 is a relatively small acute angle. Thus, the shafts 3, 4 and 17 are inclined downwardly in a direction from the front frame member 1 toward the rear frame member 2. In the apparatus of FIGS. 1–3, the means for moving the commodities 24 from the station A toward the station AA is the frame or housing which comprises the frame members 1 and 2. Thus, the housing supports the shafts 3, 4 in such a way that the bottom zone 25 of the trough 14 slopes downwardly from the frame member 1 toward the frame member 2; this causes the commodities to advance in the direction indicated by the arrow D.

The apparatus of FIG. 1 can be simplified by omitting one of the pulleys 9, 10 (preferably the pulley 10) and by replacing the V-belt 12 with a belt which is trained over the two remaining pulleys (9, 11*a*) in front of the frame member 1. Furthermore, the pulleys 9, 10, 11*a* can be replaced with a gear train.

The operation is as follows:

The commodities 24 to be treated (e.g., levers, small housings, fittings or analogous discrete parts) are admitted into the trough at the station A. The motor 11 drives the V-belt 12 and the band 13 in the directions indicated by the arrows B. As shown in FIG. 3, a commodity 24 which has descended into the bottom zone 25 of the trough 14 (position PO) is frictionally engaged by the slat or slats 21 moving from the bottom zone 25 toward the pulleys 5 and 6; such commodity adheres to the adjacent slat or slats 21 by friction until it reaches the point P1 where the gravity prevails so that the commodity descends back into the bottom zone 25 (see the position P2) to be engaged by the oncoming slat or slats which raise it to the position P3. The commodity 24 is again caused to descend by gravity (position P4); it is thereupon lifted, and so on, until it reaches the station AA where it leaves the trough 14 by way of the insert 16. The path sections 26 of a commodity 24 between the positions P0,P1,P2,P3,P4, etc. are arcuate sections whose center of curvature is located on the common axis of the inserts 15 and 16. The overall path of a commodity is a zig-zag path consisting of a large number of arcuate sections 26. The neighboring path sections 26 are inclined with respect to each other, i.e., they make angles which equal or approximate the angle beta. As a rule, the commodities 24 will roll during gravitational descent into or while dwelling in the bottom zone 25 of the trough 14. This insures that all sides of each commodity are subjected to identical or nearly identical treatment.

Since the upper side of the trough 14 (as well as each of its ends) is open, the apparatus provides ample room for the installation of suitable treating or conditioning units which may include a rotary impeller 22 for steel shot or the like and one or more nozzles 23 which can discharge a liquid washing agent or another flowable material serving to clean or rinse the surfaces of the commodities. The units may subject such surfaces to a polishing or roughening treatment or may otherwise affect the appearance and/or other characteristics of the surfaces during travel of the commodities 24 between the stations A and AA. The commodities which reach the station AA pass through the insert 16 and descend onto another conveyor or into a collecting receptacle, not shown. The impeller 22 receives flowable material from a magazine or hopper 22*a*. The source of flowable material which is fed to the nozzles 23 is not shown in the drawing. Each nozzle can discharge a different material, or two or more nozzles can discharge identical materials. Also, the spacing between the nozzles 23 need not be uniform, the number of nozzles can be less or more than four, and the impeller 22 can be installed between or downstream of the nozzles. Still further, the apparatus may comprise two or more impellers (see FIG. 22).

Figure 4:
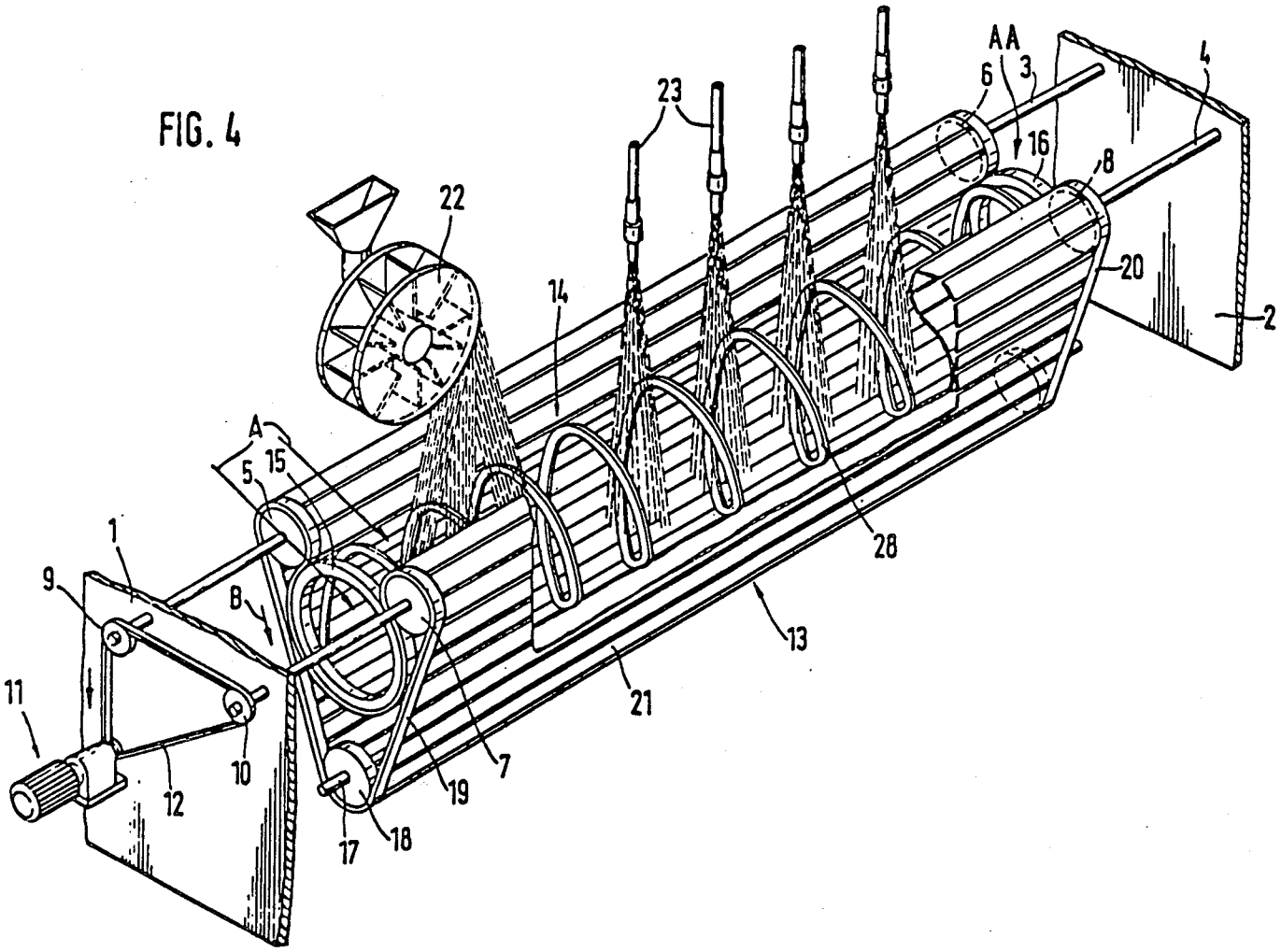
FIG. 4 is a perspective view of a second apparatus, with a portion of the conveyor broken away.
Figure 5:
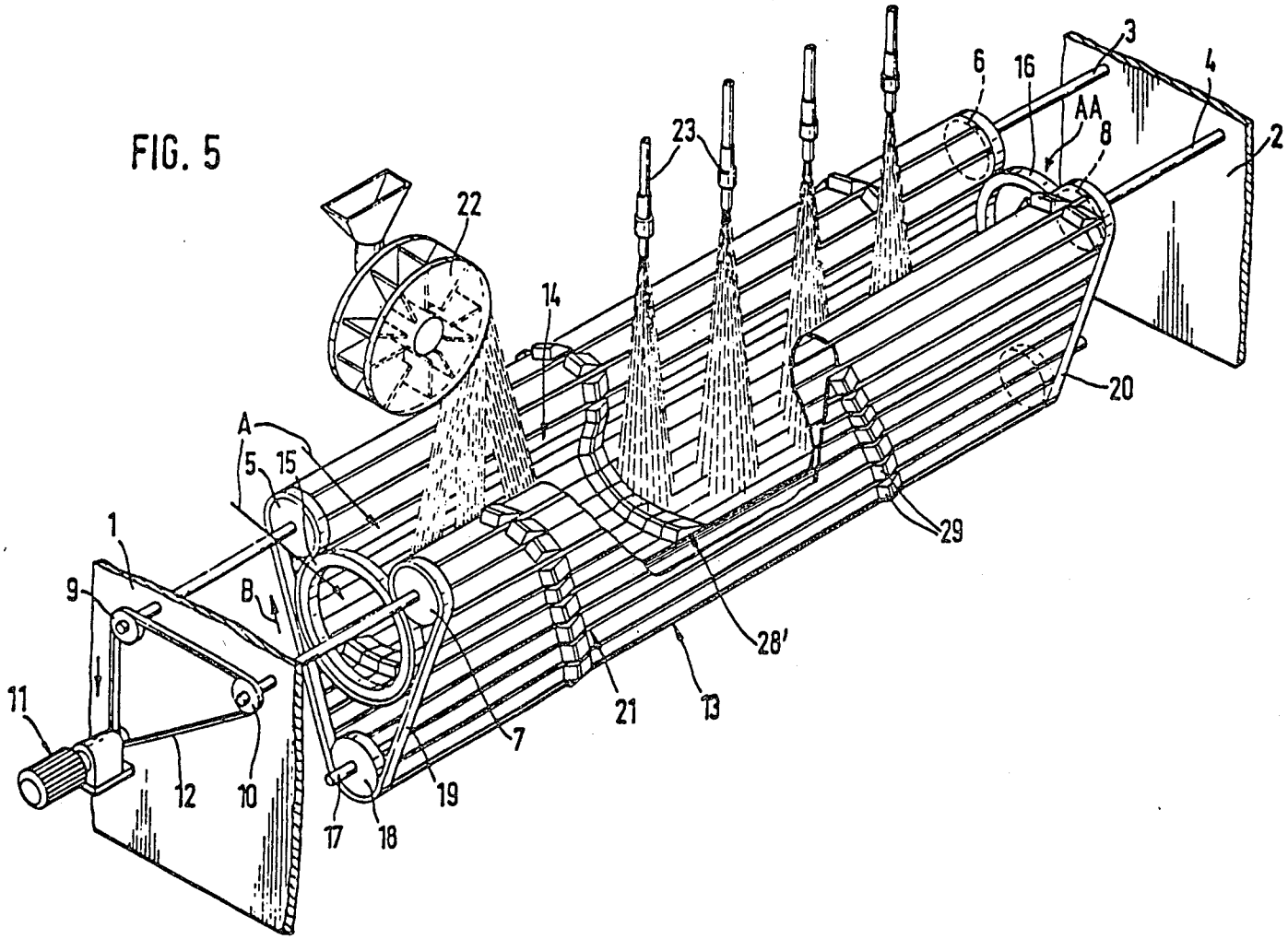
FIG. 5 is a perspective view of a third apparatus, with a portion of the conveyor broken away.

FIG. 4 shows a second apparatus wherein all such parts which are identical with or clearly analogous to the corresponding parts of the apparatus of FIGS. 1–3 are denoted by similar reference characters. The trough 14 is horizontal (or need not be inclined) because the means for moving the commodities from the station A toward the other end of the trough includes a helical advancing member 28 (hereinafter called helix) whose diameter equals the diameters of the inserts 15 and 16. The helix 28 extends from the insert 15 all the way to the insert 16 and is attached to one of the inserts (e.g., to the insert 16) so that it rotates when the motor 11 is on. This causes the convolutions of the helix 28 to advance the commodities from the station A toward the station AA substantially in the same way as described in connection with FIG. 3. The direction in which the material (e.g., metallic wire) of the helix 28 is convoluted is such that, when the insert 16 rotates clockwise (i.e., when the pulleys or sprocket wheels 5 and 7 rotate anticlockwise), the commodities are automatically advanced in a direction from the insert 15 toward and through the insert 16.

The inclination between the sections of the zig-zag path described by the commodities in the trough 14 of FIG. 4 is determined by the lead of the helix 28 (because the trough is assumed to be horizontal). A commodity which has been admitted or has descended into the bottom zone of the trough 14 of FIG. 4 is lifted as a result of frictional engagement with the adjacent slat or slats 21. When the commmodity rises to a predetermined level, the force of gravity prevails and the commodity descends back into the bottom zone of the trough 14 by sliding and/or rolling along the adjacent portion of the helix 28. The commodity is caused or is likely to roll again in the bottom zone of the trough 14 before it is engaged by the oncoming slat or slats 21 to again rise above the bottom zone. The same sequence of movements is repeated again and again until the commodity reaches the station AA. While moving upwardly, each commodity travels along an arcuate section of the zig-zag path, namely, along a section whose plane is normal to the axes of the horizontal shafts 3, 4 and 17 of FIG. 4.

FIG. 4 further shows that the commodities in the horizontal trough can be treated by flowable material propelled by or issuing from conditioning units 22 and 23 which are analogous to or identical with the similarly referenced units of FIG. 1.

FIGS. 5 to 8 show a third apparatus which constitutes a modification of the apparatus of FIG. 4. The difference between the apparatus of FIGS. 4 and 5 to 8 is that the latter apparatus does not embody a discrete helix. Instead, the band 13 is formed with a helical rib 28' intermediate the inserts 15 and 16 to advance the commodities from the station A toward the station AA. The rib 28' consists of discrete protuberances or cams 29 shown on a larger scale in FIGS. 6 to 8. The cams 29 are secured to the slats 21 in such a way that the cams on neighboring slats are staggered with respect to each other, as considered in the longitudinal direction of the slats, whereby the cams 29 in their entirety form the rib 28' which causes the commodities entering the horizontal trough 14 at the station A to advance toward the station AA.

Figure 6:
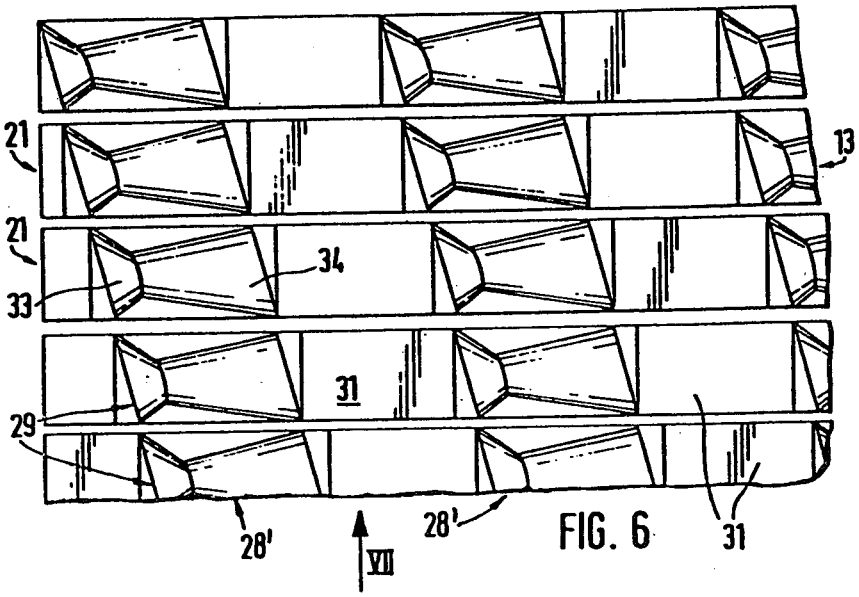
FIG. 6 is an enlarged developed view of a portion of the conveyor in the apparatus of FIG. 5.
Figure 7:
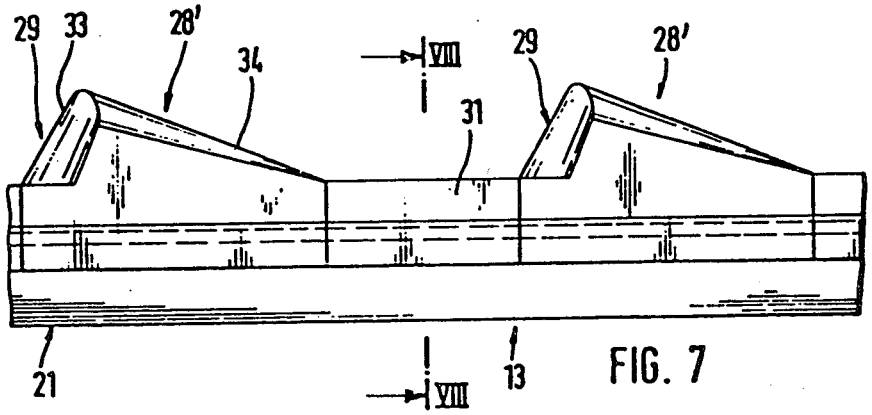
FIG. 7 is an enlarged fragmentary side elevational view of a slat as seen in the direction of arrow VII in FIG. 6.
Figure 8:
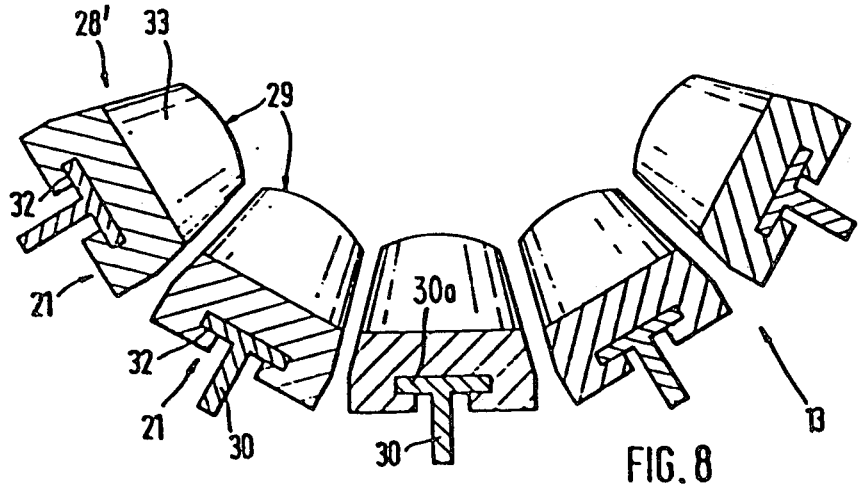
FIG. 8 is a transverse sectional view as seen in the direction of arrows from the line VIII—VIII of FIG. 7.

The slats 21 consist of or include T-shaped bars or rails 30 (see particularly FIG. 8) whose transverse portions or heads **30*a* are received in complementary T-shaped grooves 32 at the adjacent sides of the respective cams 29. FIGS. 6 and 7 show that each slat 21 carries several cams 29 separated from each other by distancing elements 31 which are also formed with T-shaped grooves (not specifically shown) so that they can be slipped onto the rails 30 of the respective slats 21. The length of the distancing elements 31 determines the spacing between neighboring cams 29 on a common slat 21. Furthermore, the length of the distancing elements 31 determines the lead of the helical rib 28'**.

Each cam 29 has a steeper flank 33 which faces toward the station A and a longer second flank 34 which slopes gradually in a direction toward the station AA. The flanks 33 and 34 are preferably bounded by convex surfaces. Such inclination and configuration of the flanks 33 and 34 compensate for the different frictional forces which develop between rounded commodities and the cams 29, on the one hand, and between polygonal commodities and the cams 29, on the other hand. The material of the cams 29, bars 30 and distancing elements 31 may but need not be the same. As a rule, the material of such parts will be selected in dependence upon the nature of the conveyed commodities and/or on the nature and impact of the treating agent or agents. The composite path along which the commodities move from the station A toward the station AA is identical or similar to the path which is described by the commodities in the trough 14 of the apparatus shown in FIG. 4.

The operation of the apparatus of FIGS. 5 to 8 is as follows: If a commodity which is admitted into the horizontal trough 14 of FIG. 5 at the station A is an elongated object, e.g., a lever, such object exhibits the tendency to assume a position in which its longitudinal directon is parallel to the longitudinal direction of the trough 14. Thus, when the band 13 is set in motion, an elongated object tends to turn about its axis. In the absence of the cams 29, such tendency of an elongated object would result in prolonged or continuous dwell of the object at or close to the station A. However, when the band 13 is in motion, a portion of the elongated object is contacted by the slightly sloping flank 34 of an oncoming cam 29. The flank 34 is inclined in such a way that it causes the elongated object to move toward the station AA, i.e., the object tends to slide downwardly along the flank 34 whereby it moves away from the station A. Furthermore, since the flank 34 moves from the bottom zone of the horizontal trough 14 toward the pulleys 5 and 6, it changes the orientation of the object, i.e., the object makes an acute angle with the longitudinal directions of the adjacent slats 21. Otherwise stated, the elongated object exhibits the tendency to assume a position at right angles to the adjacent portion of the rib 28'. Furthermore, the rib 28' insures that the elongated object is caused to move forwardly without coming into contact with the objects in the adjacent portions of the trough 14.

For treatment of certain types of commodities, the movement of the commodities toward the station AA is enhanced if the steeper flanks 33 of the cams 29 face the station AA. This can be readily achieved by changing the orientation of the cams 29 by 180 degrees prior to mounting on the respective T-shaped rails 30.

It is further clear that the illustrated cams 29 constitute but one of many types of protuberances which can be provided on the slats 21 to form at least one helical rib which moves the commodities toward the station AA. Furthermore, the rib 28' can be assembled of two or more different types of cams, and such cams can be permanently affixed to the respective slats or affixed to the slats in a manner different from that shown in FIG. 8.

Figure 9:
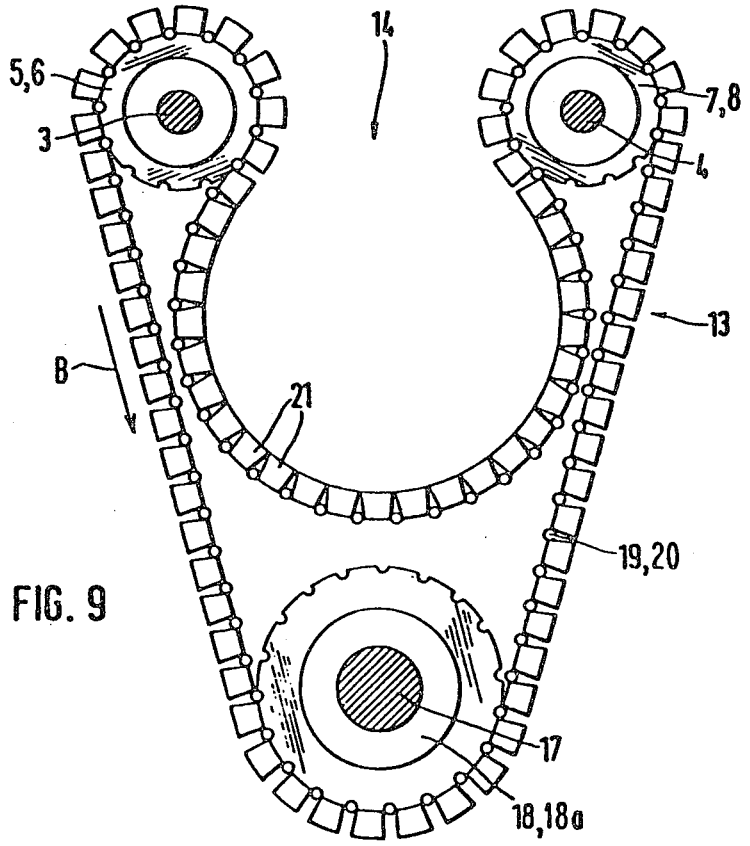
FIG. 9 is a transverse vertical sectional view of a portion of a fourth apparatus wherein the conveyor comprises two link chains.
Figure 10:
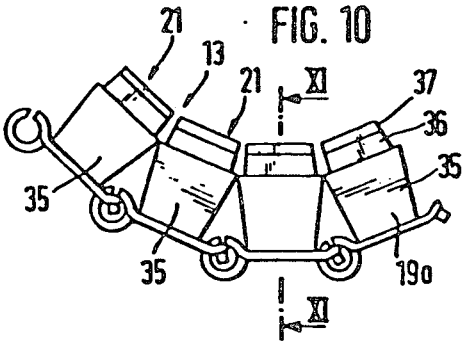
FIG. 10 is an enlarged view of a portion of the link chain shown in FIG. 9.
Figure 11:
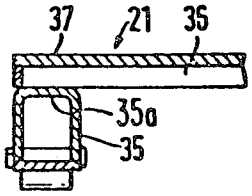
FIG. 11 is a sectional view as seen in the direction of arrows from the line XI—XI of FIG. 10.

FIGS. 9 to 11 illustrate a portion of an apparatus wherein each of the flexible elements 19 and 20 is an endless link chain. Thus, the rotary members 5–8, 18 and **18*a* are sprocket wheels. Therefore, the inserts 15** and 16 can be omitted because that portion of the band 13 which constitutes the trough 14 automatically retains its shape, especially if the slats 21 and/or the connecting means between the slats and chains 19, 20 are configurated in such a way that they abut against each other during travel from the sprocket wheels 7–8 toward the sprocket wheels 5–6. In other words, the slats 21 and/or the connecting means can be configurated in such a way that they determine the curvature of that portion of the band 13 which constitutes the trough 14.

Each link 19*a* of the chain 19 has a U-shaped connecting yoke 35 (see FIGS. 10 and 11) which extends inwardly in the trough 14 and outwardly during travel from the sprocket wheels 5, 6 toward the sprocket wheels 18, 18*a* and 7, 8. The slats 21 are secured (preferably permanently, e.g., by welding) to the webs 35*a* of the aligned pairs of yokes 35. Each slat 21 comprises an elongated bar 36 having a liner or coat 37 of wear and/or corrosion resistant material, depending on the nature of the commodities and/or treating agents. The bars 36 are rigid with the respective webs 35*a*. For example, the liners 37 may consist of high-quality steel, of an elastomeric material or of a material whose important characteristic is pronounced resistance to corrosion. The neighboring yokes 35 abut against each other during travel from the sprocket wheels 7, 8 toward the sprocket wheels 5, 6; as mentioned above, this insures that the band portion which constitutes the trough 14 assumes an optimum configuration for reception and forward transport of the commodities. In fact, even the tensioning device including the parts 17, 18 and 18*a* can be omitted because the teeth of the sprocket wheels 5 to 8 insure that the length of the band portion which forms the trough 14 remains unchanged.

The slats 21 will carry cams or analogous protuberances if the trough 14 is horizontal; if the trough is inclined in a manner as described in connection with FIGS. 1 to 3, the commodities will automatically advance toward the discharge end of the trough.

Figure 12:
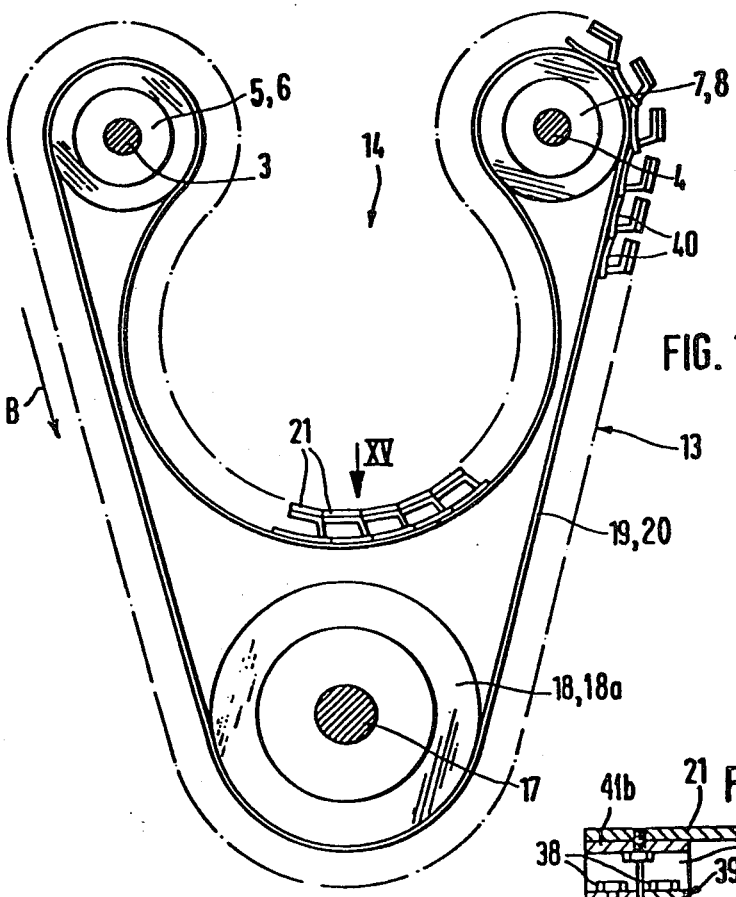
FIG. 12 is a transverse vertical sectional view of a portion of a fifth apparatus having a modified conveyor.
Figure 14:
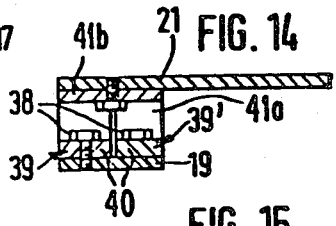
FIG. 14 is a sectional view as seen in the direction of arrows from the line XIV—XIV of FIG. 13.
Figure 13:
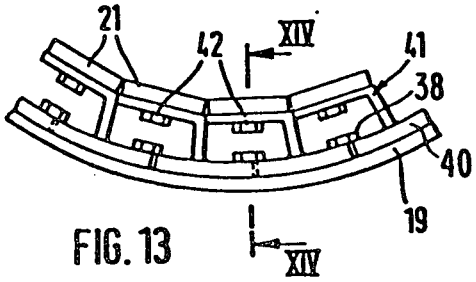
FIG. 13 is an enlarged view of a portion of the conveyor of FIG. 12.
Figure 15:
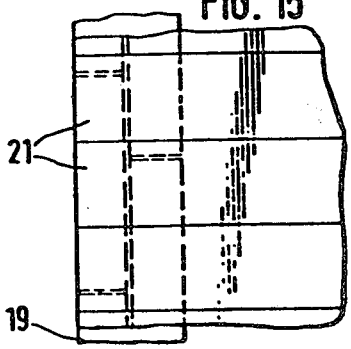
FIG. 15 is a plan view of a portion of the conveyor as seen in the direction of arrow XV in FIG. 12.

FIGS. 12 to 15 show an embodiment which is similar to the just described embodiment, i.e., the inserts 15 and 16 can be omitted because the configuration of the endless flexible elements 19 and 20 is such that the trough 14 retains its shape as a result of movement of neighboring slats 21 into abutment with each other or as a result of movement of connecting means for the slats into abutment with each other during travel from the rotary members 7 and 8 toward the rotary members 5 and 6. The flexible elements 19 and 20 are endless belts which are connected to the respective ends of the slats 21 in a manner as shown in FIGS. 13 to 15. The connecting means includes two rows 39 and 39′ of arcuate shoes 40 which are affixed to the belt 19 by bolts 38 or analogous fasteners. The shoes 40 of the row 39 are offset with respect to the shoes of the row 39′, as considered in the longitudinal direction of the belt 19. The extent of offset equals one-half the length of a shoe 40. Each shoe carries an L-shaped (profiled) holder 41 whose shank 41*a* is relatively narrow (its width equals the width of the respective shoe 40) and whose head 41*b* has the width of the belt 19. The end portions of the slats 21 are affixed to the respective heads 41*b* by screws 42 or analogous fasteners.

The distribution of the heads 41*b* is such that the neighboring heads are slightly spaced apart during travel with the flat stretches of the band 13 (namely, between the pulleys 7, 8 and pulleys 18, 18*a* as well as between the pulleys 18, 18*a* and pulleys 5, 6), that the gaps between neighboring heads 41*b* are much wider during travel with the convex portions of the band 13 (namely, about the pulleys 5–8, 18, 18*a*) and that the width of the gaps is reduced to zero (i.e., the neighboring heads 41*a* abut against each other) in that (concave) portion of the band 13 which constitutes the trough 14. This insures that the configuration of the trough 14 does not change when the band 13 is in motion.

The trough 14 of FIG. 12 slopes in a direction from the feeding station toward the discharging station, i.e., in a direction from the belt 19 toward the belt 20. However, it is equally possible to provide the slats 21 of FIG. 12 with cams 29 or analogous protuberances which form one or more helical ribs; the band 13 of FIG. 12 is then supported in such a way that the trough 14 is horizontal.

The partially overlapping shoes 40 of the two rows 39 and 39′ insure satisfactory transition from the concave to the convex portions of the band 13, i.e., in the regions downstream of the pulleys 7 and 8 and upstream of the pulleys 5 and 6.

The apparatus of FIGS. 16 to 18 comprises a conveyor or band 13 wherein each of the flexible elements 19, 20 is an endless belt. The band 13 is trained over the rotary members 5–8, 18, 18*a* and the ring-shaped inserts 15, 16 the same as in the embodiment of FIGS. 1 to 3. The inserts 15, 16 insure that the shape of the trough 14 remains unchanged. The spacing between the slats 21 of the band 13 is not critical because such slats (and/or the connecting means therefor) need not determine the configuration of the trough 14; the gaps between the slats are merely selected with a view to prevent escape of the commodities and to insure satisfactory evacuation of treating agents. Furthermore, as explained in connection with FIGS. 1 to 3, the spacing between the slats 21 must be sufficient to enable the belts 19, 20 to follow the outlines of the respective inserts 15, 16 during travel from the pulleys 7, 8 toward the pulleys 5, 6.

The end portions of the slats 21 are welded to shallow U-shaped connecting brackets 43 which are attached to the respective belts 19, 20 by screws 44 or analogous fasteners. The inserts 15, 16 have circumferential grooves (see the groove 15B in FIG. 17) which accommodate the heads of the screws 44 during travel of the respective slats from the pulleys 7, 8 toward the pulleys 5, 6. The slats 21 consist of metallic sheet material and are perforated (as shown in FIG. 18). For example, the slats 21 may be made of manganese steel if the commodities in the trough 14 are treated with steel shot or the like.

Figure 19:
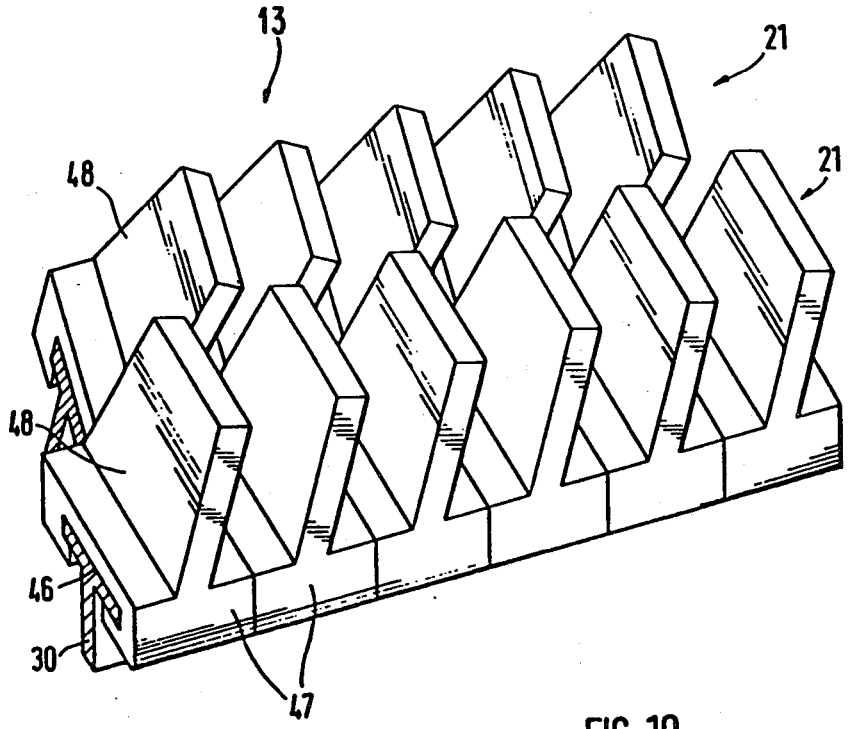
FIG. 19 is a perspective view of a portion of a further conveyor.

FIG. 19 shows a portion of a further band 13 wherein the T-shaped rails 30 of the slats 21 support modified protuberances 47 having T-shaped grooves 46 for the respective rails 30. Each protuberance comprises a base which is formed with the groove 46 and an outwardly projecting flat extension 48 which is inclined in a direction toward the discharge end of the trough. The extensions 48 of the protuberances 47 on neighboring T-rails 30 are staggered with respect to each other, as considered in the longitudinal direction of the slats. Such protuberances may constitute one or more helical ribs.

The protuberances 47, and especially the extensions 48, preferably consist of an elastomeric material. This insures that, when a relatively heavy commodity rests on the outermost portions or top lands of the extensions 48, such extensions are flexed in a direction toward the discharge end and thus promote the forward movement of the commodities toward the discharging station.

An apparatus which embodies the band 13 of FIG. 19 is especially suited for the transport and treatment of relatively large and sensitive commodities. The extensions 48 form a cushion for the commodities in the trough and promote the forward movement of such commodities due to their elastic nature. The band of FIG. 13 can be used with advantage in apparatus wherein the commodities are subjected to the action of a liquid washing agent and/or to the action of a soft blasting medium.

Figure 20:
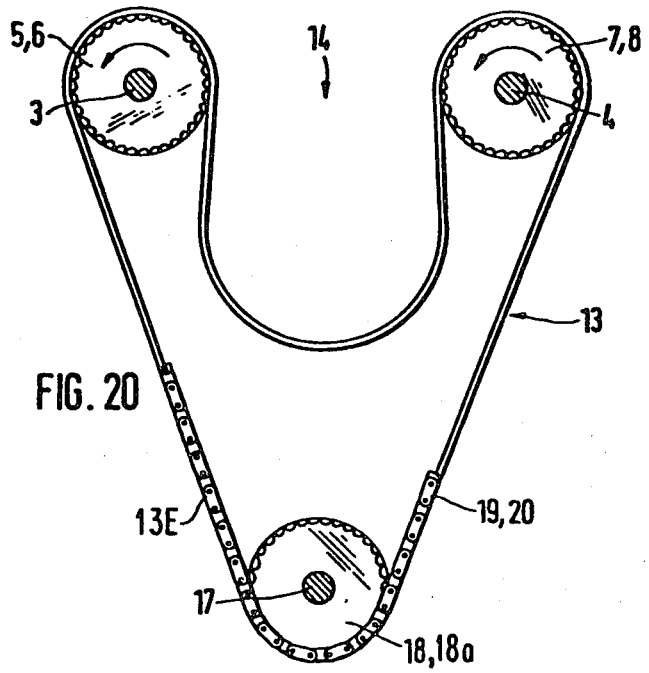
FIG. 20 is a schematic transverse sectional view of a portion of still another apparatus.

FIG. 20 shows a further embodiment wherein the endless flexible elements 19 and 20 constitute roller chains. Therefore, the rotary members 5–8 and 18, 18*a* constitute specially designed sprocket wheels with concave tooth spaces for the rollers (not specifically shown) of the chains 19 and 20. The prime mover (not shown) drives the shafts 3 and 4 in such a way that the peripheral speed of the sprocket wheels 5, 6 equals the peripheral speed of the sprocket wheels 7, 8. The band portion between the shafts 3 and 4 is looped under its own weight and under the weight of the commodities to form a trough 14 whose contour approximates that of the previously described troughs. If the trough 14 of FIG. 20 is inclined in a direction toward the discharging station, the band 13 need not be provided with any article advancing or entraining means; if the trough 14 is horizontal, the band 13 carries protuberances which define one or more helices.

The apparatus of FIG. 20 will be utilized when the fact that the configuration of the trough 14 changes in response to the admission of commodities at the feeding station, i.e., that the configuration of the trough 14 is not fixed, does not affect the treatment.

Figure 21:
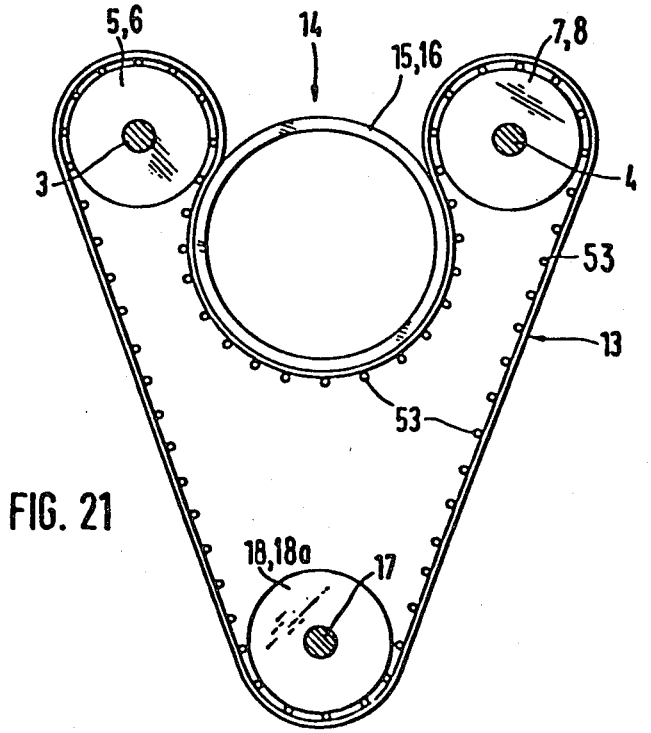
FIG. 21 is a similar sectional view of a portion of an additional apparatus.

In the embodiment of FIG. 21, the entire band 13 consists of rubber or another elastomeric material and its inner side is provided with spaced-apart parallel rod-shaped rungs 53. These rungs reinforce the readily deformable band 13 and insure predictable movement of the band along the path defined by the rotary members 5–8, 18, 18*a* and the inserts 15, 16. If the rotary members 5–8, 18 and 18*a* are sprocket wheels, the rungs 53 can be said to constitute internal teeth which insure that the band 13 cannot slip during movement therealong. The band 13 consists of foraminous material or is perforated to permit one or more flowable treating agents to pass therethrough. It is clear that the band 13 may constitute a relatively wide belt made of textile material or the like (i.e., of material which is elastic), as long as the material can stand the stresses which develop in use and can also stand the corrosive influence of and/or mechanical stressing by the treating agent or agents.

Figure 22:
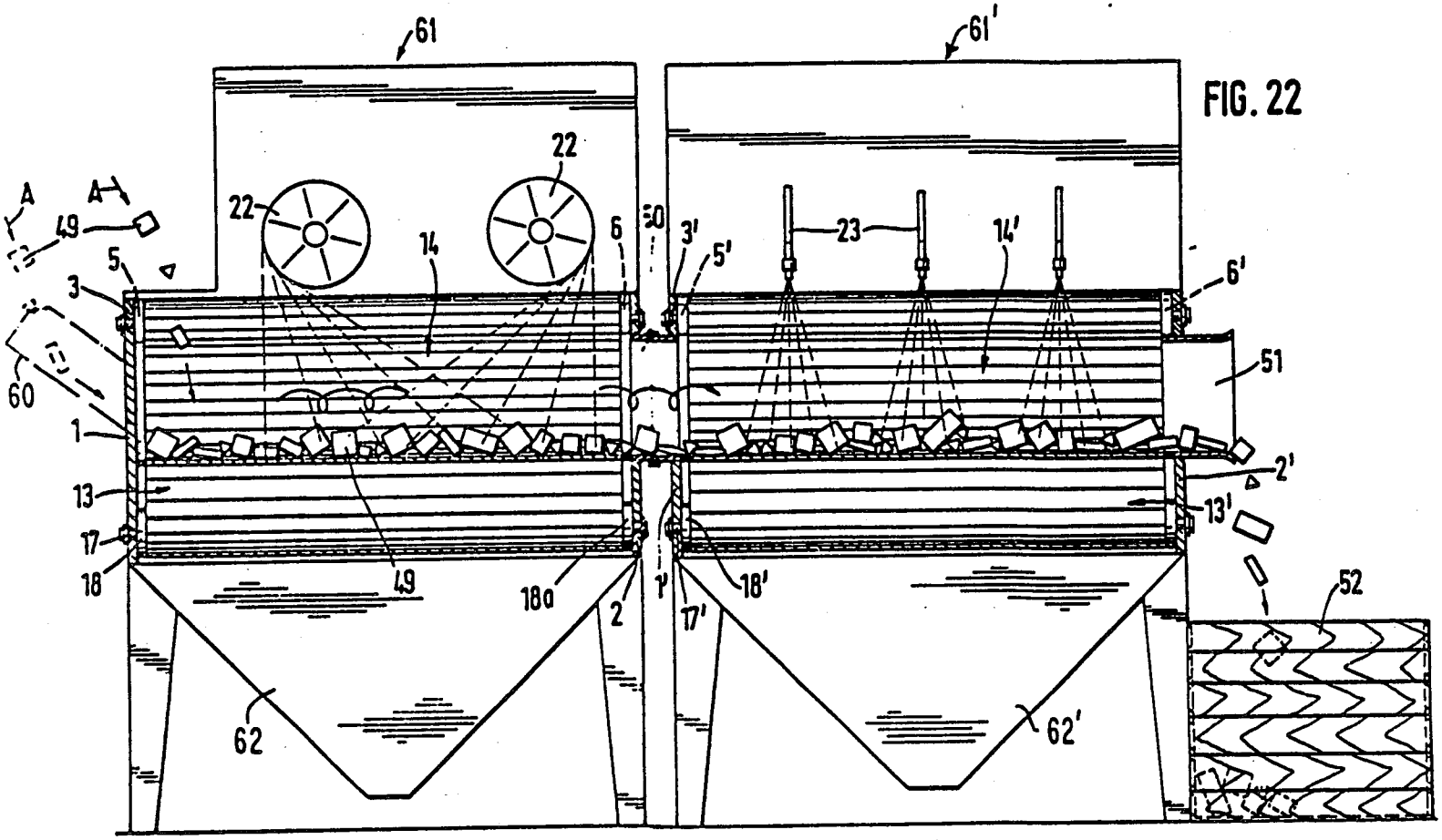
FIG. 22 is a schematic elevational view of a pair of series-connected apparatus which embody the invention.

FIG. 22 shows a composite apparatus wherein the treatment of commodities 49 by steel shot or the like takes place in a first trough 14 and the treatment of such commodities by a liquid medium (e.g., a washing agent) takes place in a second trough 14'. The left-hand band 13 includes the first trough 14 and the latter receives discrete commodities 49 at the station A. The commodities 49 can be introduced from above directly into the left-hand end of the left-hand trough 14 and/or can be introduced by way of a suitable conveyor (e.g., a chute 60) which feeds commodities into the left-hand end of the left-hand trough by way of an opening in the frame member 1. The housing or frame 61 which includes the members 1 and 2 supports the respective band 13 in such a way that the trough 14 is horizontal; therefore, the slats of the band 13 preferably carry protuberances (not shown in FIG. 22) of the type shown in FIG. 5, i.e., the band 13 has a helical rib which advances the commodities 49 toward the frame member 2. The trough 14 delivers the commodities 49 into a tubular member 50 which admits such commodities into the left-hand end of the trough 14' of the right-hand band 13'. If the trough 14' is horizontal, the band 13' is also provided with a helical rib (not shown) or contains a rotating helix of the type shown in FIG. 4. The finished commodities 49 pass through a second tubular member 51 at the discharge end of the trough 14' and descend into a collecting receptacle 52 or onto a further conveyor, not shown.

The parts which are located between the tubular members 50 and 51 are denoted by similar reference numerals as those used for the parts between the chute 60 and tubular member 50 but each followed by a prime.

The frame 61 supports two rotary impellers 22 for a solid blasting agent. These impellers rotate in opposite directions to cause the admission of solid particles in and counter to the direction of movement of the commodities 49 in the trough 14. This further increases the likelihood that each and every surface of each and every commodity is treated to the same extent. FIG. 22 shows that the commodities in the trough 14 assume a practically infinite number of different positions during travel from the station A to the tubular member 50; this insures uniform treatment of all sides of the commodities.

The commodities in the trough 14' are treated by a liquid washing agent which is sprayed into the trough 14' by one or more nozzles 23.

In each and every embodiment of the invention, the width of the gaps between neighboring slats, the size and/or distribution of perforations in the slats, and/or the size and/or distribution of apertures or perforations in a band which consists, in its entirety, of an elastomeric or textile material will depend on one or more of the aforementioned factors including the dimensions of the commodities, the rate of the admission of treating agent or agents and the desired rate of evacuation of such agent or agents from the trough or troughs. FIG. 22 shows two collecting tanks 62 and 62' for flowable solid and liquid treating agents.

The nature of the slats which form part of certain embodiments of the improved band also depends on a variety of factors. Thus, those sides of the slats which come into contact with the commodities to be treated (and hence also with the flowable solid and/or liquid treating agents) may be coated with liners consisting of rubber or elastomeric synthetic plastic material (it is also possible to make the slats or the band 13 entirely of an elastomeric material), especially if the commodities to be treated are contacted by a liquid washing agent and/or by mineral or other non-corrosive solid conditioning media. If the kinetic energy of the solid particles which are used to treat the commodities is very high (for example, when castings are treated by steel shot), the slats can be made of highly impact-resistant steel. If the commodities are to be treated with a corrosive washing liquid, the slats will be made of acid-resistant stainless steel or another alloy exhibiting similar characteristics.

In each embodiment of the invention, the band 13 is preferably weighted by utilizing the tensioning device 17, 18 and 18*a*. However, such tensioning device is not absolutely necessary, especially if the band includes link chains which are trained over sprocket wheels. If the illustrated tensioning device is not practical, it can be replaced with other types of tensioning devices, for example, with spring-biased levers which carry the rotary members 18, 18*a* and tension the looped portion 13E of the band 13 below the trough 14.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for continuously transporting and changing the orientation of metallic objects or other discrete commodities, comprising substantially parallel first and second direction changing means; an endless band-like conveyor trained over and having a trough-shaped portion between said direction changing means; a feeding station disposed at one end of said trough-shaped portion for admission of discrete commodities into said one end; means for driving said conveyor; and means for forwarding the commodities from said one end toward the other end of said trough-shaped portion, said forwarding means including discrete extensions resiliently affixed to said conveyor so as to extend at an angle inclined with respect to the surface of said conveyor in a direction toward said other end for resiliently flexing in said direction whereby a commodity on said extensions having sufficient weight to deflect the same will be conveyed in said direction, said extensions being arranged with respect to each other so as to form at least one generally helical rib to assist in moving the commodities toward said other end.

2. Apparatus as defined in claim 1, further comprising means for directing at least one flowable treating agent against the commodities in said trough-shaped portion.

3. Apparatus as defined in claim 1, wherein each of said direction changing means comprises a shaft and two rotary members on the respective shaft, said conveyor being trained over said rotary members.

4. Apparatus as defined in claim 3, wherein said driving means comprises means for transmitting torque to at least one of said shafts and to the respective rotary members.

5. Apparatus as defined in claim 1, wherein said conveyor comprises two end portions each constituting an endless flexible element and a plurality of elongated connecting members extending between and having end portions secured to said flexible elements.

6. Apparatus as defined in claim 1, wherein said conveyor includes a second portion located below said trough-shaped portion; and further comprising means for spacing said second portion from said trough-shaped portion.

7. Apparatus as defined in claim 1, wherein each of said direction changing means comprises two coaxial rotary members at said ends of said trough-shaped portion and said conveyor comprises two endless flexible elements each trained over a different rotary member of each of said direction changing means.

8. Apparatus as defined in claim 7, wherein said flexible elements are belts.

9. Apparatus as defined in claim 1, further comprising shape-retaining inserts at said ends of said trough-shaped portion.

10. Apparatus as defined in claim 9, wherein said inserts have cylindrical peripheral surfaces; and further comprising means for biasing said inserts against said direction changing means.

11. Apparatus as defined in claim 9, wherein the insert at said other end of said trough-shaped portion is an annulus.

12. Apparatus as defined in claim 10, wherein said trough-shaped portion surrounds said inserts along an arc of at least 180 degrees.

13. Apparatus as defined in claim 1, wherein said conveyor comprises a plurality of elongated slats having portions which contact the commodities in said trough-shaped portion and consist of highly wear-resistant material.

14. Apparatus as defined in claim 1, wherein said extensions define a plurality of helical ribs in the region of said trough-shaped portion.

15. Apparatus as defined in claim 1, wherein said conveyor comprises a plurality of elongated slats and said extensions are affixed to said slats.

16. Apparatus as defined in claim 1, wherein said extensions are affixed to an outwardly facing side of said conveyor.

17. Apparatus as defined in claim 1, wherein said extensions have a generally parallelepipedal form.

18. Apparatus for continuously transporting and changing the orientation of metallic objects or other discrete commodities, comprising substantially parallel first and second direction changing means; an endless band-like conveyor trained over and having a trough-shaped portion between said direction changing means; a feeding station disposed at one end of said trough-shaped portion for admission of discrete commodities into said one end; means for driving said conveyor; and means for forwarding the commodities from said one end toward the other end of said trough-shaped portion, said forwarding means including a plurality of extensions resiliently affixed to said conveyor so as to extend at an angle inclined with respect to the surface of said conveyor in a direction toward said other end for resiliently flexing in said direction whereby a commodity on said extensions having sufficient weight to deflect the same will be conveyed in said direction.

19. Apparatus as defined in claim 18, wherein said extensions have a generally parallelepipedal form.

* * * * *